US011521625B2

(12) United States Patent
Kawashima et al.

(10) Patent No.: US 11,521,625 B2
(45) **Date of Patent: *Dec. 6, 2022**

(54) AUDIO SIGNAL CODING APPARATUS, AUDIO SIGNAL DECODING APPARATUS, AUDIO SIGNAL CODING METHOD, AND AUDIO SIGNAL DECODING METHOD

(71) Applicant: Fraunhofer-Gesellschaft zur Foerderung der angewandten Forschung e.V., Munich (DE)

(72) Inventors: Takuya Kawashima, Ishikawa (JP); Hiroyuki Ehara, Kanagawa (JP)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 200 days.

This patent is subject to a terminal disclaimer.

(21) Appl. No.: 16/821,784

(22) Filed: Mar. 17, 2020

(65) Prior Publication Data

US 2020/0219518 A1 Jul. 9, 2020

Related U.S. Application Data

(63) Continuation of application No. 16/370,748, filed on Mar. 29, 2019, now Pat. No. 10,643,623, which is a (Continued)

(30) Foreign Application Priority Data

Oct. 28, 2014 (JP) ..... 2014-219214

(51) Int. Cl.
*G10L 19/002* (2013.01)
*G10L 19/02* (2013.01)
(Continued)

(52) U.S. Cl.
CPC ..... *G10L 19/002* (2013.01); *G10L 19/0204* (2013.01); *G10L 19/0208* (2013.01); *G10L 19/032* (2013.01); *G10L 19/035* (2013.01)

(58) Field of Classification Search
USPC ..... 704/500–504
See application file for complete search history.

(56) References Cited

U.S. PATENT DOCUMENTS 5,870,703 A 2/1999 Oikawa et al.
5,873,058 A 2/1999 Yajima et al.
(Continued)

FOREIGN PATENT DOCUMENTS

CN 101548316 A 9/2009
CN 101853663 A 10/2010
(Continued)

OTHER PUBLICATIONS

ITU-T, "G.719: Low-complexity, full-band audio coding for high-quality, conversational applications", Recommendation ITU-T G.719, Telecommunication Standardization Sector of ITU,, Jun. 2008, 58 pages.

*Primary Examiner* — Leonard Saint Cyr
(74) *Attorney, Agent, or Firm* — Perkins Coie LLP; Michael A. Glenn

(57) ABSTRACT

An audio signal coding apparatus includes a time-frequency transformer that outputs sub-band spectra from an input signal; a sub-band energy quantizer; a tonality calculator that analyzes tonality of the sub-band spectra; a bit allocator that selects a second sub-band on which quantization is performed by a second quantizer on the basis of the analysis result of the tonality and quantized sub-band energy, and determines a first number of bits to be allocated to a first sub-band on which quantization is performed by a first quantizer; the first quantizer that performs first coding using
(Continued)

the first number of bits; the second quantizer that performs coding using a second coding method; and a multiplexer.

13 Claims, 7 Drawing Sheets

Related U.S. Application Data continuation of application No. 15/353,780, filed on Nov. 17, 2016, now Pat. No. 10,311,879, which is a continuation of application No. PCT/JP2015/003358, filed on Jul. 3, 2015.

(60) Provisional application No. 62/028,805, filed on Jul. 25, 2014.

(51) Int. Cl.
*G10L 19/032* (2013.01)
*G10L 19/035* (2013.01)

(56) References Cited

U.S. PATENT DOCUMENTS

| | | | | |
|---|---|---|---|---|
| 5,983,172 | A | 11/1999 | Takashima et al. | |
| 7,333,930 | B2 | 2/2008 | Baumgarte | |
| 7,389,227 | B2 | 6/2008 | Kang et al. | |
| 7,627,469 | B2 | 12/2009 | Nettre et al. | |
| 10,269,361 | B2 | 4/2019 | Nagisetty et al. | |
| 2005/0267744 | A1* | 12/2005 | Nettre | G10L 19/032 704/E19.015 |
| 2006/0251178 | A1 | 11/2006 | Oshikiri | |
| 2007/0016403 | A1 | 1/2007 | Schuller et al. | |
| 2007/0043557 | A1 | 2/2007 | Schuller et al. | |
| 2010/0169081 | A1 | 7/2010 | Yamanashi et al. | |
| 2010/0286990 | A1* | 11/2010 | Biswas | G10L 19/008 704/500 |
| 2012/0039414 | A1* | 2/2012 | Fang | G10L 19/005 375/295 |
| 2013/0282383 | A1* | 10/2013 | Hedelin | G10L 19/26 704/500 |
| 2015/0294673 | A1 | 10/2015 | Kawashima et al. | |
| 2015/0317991 | A1 | 11/2015 | Liu et al. | |
| 2016/0064007 | A1* | 3/2016 | Villemoes | G10L 19/032 704/203 |
| 2018/0211677 | A1* | 7/2018 | Klejsa | G10L 19/035 |
| 2018/0322886 | A1* | 11/2018 | Villemoes | G10L 19/06 |

FOREIGN PATENT DOCUMENTS

| | | | |
|---|---|---|---|
| CN | 102063905 | A | 5/2011 |
| CN | 102194458 | A | 9/2011 |
| CN | 102750953 | A | 10/2012 |
| CN | 104838443 | A | 8/2015 |
| JP | 3250376 | B2 | 6/1994 |
| JP | 07336233 | A | 12/1995 |
| JP | 2005265865 | A | 9/2005 |
| JP | 2013534328 | A | 9/2013 |
| JP | 5403949 | B2 | 11/2013 |
| RU | 2012120850 | A | 12/2013 |
| WO | 2005027095 | A1 | 3/2005 |
| WO | 2007011657 | A2 | 1/2007 |
| WO | 2008133400 | A1 | 11/2008 |
| WO | 2011086924 | A1 | 7/2011 |
| WO | 2012016126 | A2 | 2/2012 |
| WO | 2014068995 | A1 | 5/2014 |
| WO | 2015151451 | A1 | 10/2015 |

* cited by examiner

AUDIO SIGNAL CODING APPARATUS, AUDIO SIGNAL DECODING APPARATUS, AUDIO SIGNAL CODING METHOD, AND AUDIO SIGNAL DECODING METHOD

CROSS-REFERENCES TO RELATED APPLICATIONS

This application is a continuation of copending U.S. patent application Ser. No. 16/370,748, filed on Mar. 29, 2019, which is a continuation of copending U.S. patent application Ser. No. 15/353,780, filed Nov. 17, 2016, which is a continuation of copending International Application No. PCT/JP2015/003358, filed Jul. 3, 2015, which is incorporated herein by reference in its entirety, and additionally claims priority from U.S. Application No. 62/028,805, filed Jul. 25, 2014, and from Japanese Patent Application JP 2014-219214, which are incorporated herein by reference in their entirety.

The present disclosure relates to a coding technique and a decoding technique for improving the audio quality of audio signals, such as speech signals and music signals.

BACKGROUND OF THE INVENTION

A coding technique for compressing audio signals at a low bit rate is a technique essential to realize the effective use of radio waves and so on in mobile communication. Meanwhile, there has recently been an increasing desire to improve audio quality in telephone communication, and implementation of telephone communication services that produce a greater sensation of presence is anticipated. To implement such services, audio signals having a wide frequency band at a high bit rate have to be coded. However, this approach conflicts with the effective use of radio waves and frequency bands.

Now, an audio signal coding technique adopted by Standard G.719 (ITU-T Standard G.719, 2008), for example, is studied.

In Standard G.719, upon coding an audio signal, a frequency transform is performed on the audio signal, and predetermined bits are allocated to a spectrum obtained as a result of the frequency transform. Specifically, the spectrum is divided into sub-bands having predetermined frequency bandwidths, and a unit (a unit having a needed number of bits) used in quantization based on lattice vector quantization is allocated to each of the sub-bands in decreasing order of energy as follows.

(1) One unit is allocated to a sub-band having the largest energy among all of the sub-bands.

One bit is allocated per spectrum. Therefore, if the number of spectral samples in a sub-band is eight, for example, one unit contains eight bits (note that the maximum number of bits that can be allocated per spectrum is nine bits, and therefore, if the number of spectral samples in a sub-frame is eight, up to 72 bits can be allocated).

(2) The quantized sub-band energy of the sub-band to which one unit has been allocated is decreased by two levels (6 dB). If the number of bits allocated to the sub-band to which one unit has been allocated exceeds the maximum value (nine bits), the sub-band is excluded from quantization in the succeeding loops.

Back to (1) above, the same process is repeated.

FIG. 6 illustrates the sub-band energy of each sub-band. The horizontal axis represents the frequency, and the vertical axis represents the amplitude on a logarithmic scale. In the figure, the sub-band energy of each sub-band is represented by a horizontal line instead of a point. The length of each horizontal line represents the frequency bandwidth of each sub-band.

FIG. 7 and FIG. 8 are diagrams illustrating examples of the results of bit allocation to each sub-band in a case of using a coding method specified in Standard G.719. In the figures, the horizontal axis represents the frequency, and the vertical axis represents the allocated number of bits. FIG. 7 illustrates a case of a bit rate of 128 kbit/s, and FIG. 8 illustrates a case of a bit rate of 64 kbit/s.

In the case of 128 kbit/s, an abundant bit budget is available for allocation, and therefore, nine bits, which is the maximum value, can be allocated to a large number of sub-bands (spectra), and the quality of audio signals can be maintained at a high level.

In contrast, in the case of 64 kbit/s, no sub-band is allocated nine bits, which is the maximum value, but every sub-band is allocated some bits. Accordingly, it is considered that degradation in the quality of audio signals can be suppressed and the effective use of radio waves and frequency bands can be realized.

However, the effective use of radio waves and frequency bands needs to be further promoted. Here, in a case of coding an audio signal having a sampling frequency of about 32 kHz at a low bit rate of 20 kbps/s or less by using the above-described method adopted by Standard G.719, it is not possible to reserve a unit (a number of bits) used in quantization of all sub-bands, which is a problem.

FIG. 9 is a diagram illustrating an example of the result of bit allocation to each sub-band in a case of using the coding method specified in Standard G.719 at 20 kbit/s. As illustrated, bit allocation fails not only in a high-frequency range but also, depending on the situation, in a low-frequency range, which is essential for hearing. Consequently, coding of spectra in the corresponding sub-bands is not possible, resulting in significant degradation in the quality of audio signals.

To solve such a problem, a method for dynamically changing a bit allocation method may be employed (Japanese Unexamined Patent Application Publication (Translation of PCT Application) No. 2013-534328).

However, the bit allocation method is changed while a single coding method (quantization method) is used without changing the coding method (quantization method), and therefore, this approach to degradation in the quality of audio signals has a limited effect.

SUMMARY

According to an embodiment, an audio signal coding apparatus may have: a time-frequency transformer that generates a spectrum having performing a transform on an input audio signal into a frequency domain, divides the spectrum into a plurality of sub-bands, which are predetermined frequency bands, and outputs sub-band spectral samples; a sub-band energy quantizer that acquires, for each of the plurality of sub-bands, a quantized sub-band energy; a tonality calculator that analyzes a tonality of the sub-band spectral samples and output an analysis result; a bit allocator that selects a second sub-band on which quantization is performed by a second quantizer from among the plurality of sub-bands on the basis of the analysis result for the tonality and the quantized sub-band energy, and determine a first number of bits to be allocated to a first sub-band, among the plurality of sub-bands, on which quantization is performed by a first quantizer; and a multiplexer that multiplexes information output from the first quantizer and from the second quantizer, the quantized sub-band energy, and the analysis result of the tonality, and outputs the multiplexed information, wherein the first quantizer codes a sub-band spectral sample among the sub-band spectral samples that is included in the first sub-band by a first coding method using the first number of bits, and the second quantizer codes a sub-band spectral sample among the sub-band spectral samples that is included in the second sub-band by a second coding method to acquire the coded information output from the second quantizer, wherein the second coding method is configured for calculating lag information for the second subband.

According to another embodiment, an audio signal decoding apparatus for decoding coded information may have: a demultiplexer that demultiplexes the coded information into first coded information, second coded information, quantized sub-band energy acquired by quantizing energy of each sub-band among the plurality of sub-bands, and an analysis result for a tonality calculated for each sub-band among the plurality of sub-bands; a bit allocator that selects the second sub-band on which decoding is performed by a second decoder from among the plurality of sub-bands on the basis of the analysis result for the tonality and the quantized sub-band energy, and determines a first number of bits to be allocated to a first sub-band, among the plurality of sub-bands, on which decoding is performed by a first decoder; and a frequency-time transformer that generates and outputs an output audio signal by performing a transform on a spectrum output from the second decoder into a time domain, wherein the first decoder generates a first decoded spectrum by decoding the first coded information using the first number of bits, and the second decoder generates a second decoded spectrum using decoding the second coded information, and generates a reconstructed spectrum by combining the second decoded spectrum and the first decoded spectrum.

According to another embodiment, a terminal apparatus may have: the inventive audio signal coding apparatus; and an antenna that transmits the coded information.

According to another embodiment, a terminal apparatus may have: an antenna that receives and outputs to the demultiplexer the coded information; and the inventive audio signal decoding apparatus.

According to another embodiment, an audio signal coding method may have the steps of: generating a spectrum by performing a transform on an input audio signal into a frequency domain; dividing the spectrum into a plurality of sub-bands, which are predetermined frequency bands, and outputting sub-band spectral samples; acquiring, for each of the plurality of sub-bands, quantized sub-band energy; analyzing a tonality of the sub-band spectral samples and outputting an analysis result; selecting a second sub-band from among the plurality of sub-bands on the basis of the analysis result for the tonality and the quantized sub-band energy; determining a first number of bits to be allocated to a first sub-band among the plurality of sub-bands; generating first coded information by coding a sub-band spectral sample among the sub-band spectral samples that is included in the first sub-band by a first coding method using the first number of bits; generating second coded information by coding a sub-band spectral sample among the sub-band spectral samples that is included in the second sub-band by using a second coding method, wherein the second coding method is configured for calculating lag information for the second subband; and multiplexing together and outputting the first coded information and the second coded information.

According to another embodiment, an audio signal decoding method for decoding coded information may have the steps of: demultiplexing the coded information into first coded information, second coded information, quantized sub-band energies for each sub-band among a plurality of sub-bands, and an analysis result for a tonality calculated for each sub-band among the plurality of sub-bands; selecting a second sub-band from among the plurality of sub-bands on the basis of the analysis result for the tonality and the quantized sub-band energy; determining a first number of bits to be allocated to a first sub-band among the plurality of sub-bands; generating a first decoded spectrum by decoding the first coded information using the first number of bits; generating a second decoded spectrum using decoding the second coded information, and generating a reconstructed spectrum by combining the second decoded spectrum and the first decoded spectrum; and generating and outputting an output audio signal by performing a transform on the reconstructed spectrum into a time domain.

Another embodiment may have a non-transitory digital storage medium having a computer program stored thereon to perform the audio signal coding method having the steps of: generating a spectrum by performing a transform on an input audio signal into a frequency domain; dividing the spectrum into a plurality of sub-bands, which are predetermined frequency bands, and outputting sub-band spectral samples; acquiring, for each of the plurality of sub-bands, quantized sub-band energy; analyzing a tonality of the sub-band spectral samples and outputting an analysis result; selecting a second sub-band from among the plurality of sub-bands on the basis of the analysis result for the tonality and the quantized sub-band energy; determining a first number of bits to be allocated to a first sub-band among the plurality of sub-bands; generating first coded information by coding a sub-band spectral sample among the sub-band spectral samples that is included in the first sub-band by a first coding method using the first number of bits; generating second coded information by coding a sub-band spectral sample among the sub-band spectral samples that is included in the second sub-band by using a second coding method, wherein the second coding method is configured for calculating lag information for the second subband; and multiplexing together and outputting the first coded information and the second coded information; when said computer program is run by a computer.

Another embodiment may have a non-transitory digital storage medium having a computer program stored thereon to perform the audio signal decoding method for decoding coded information, the audio signal decoding method having the steps of: demultiplexing the coded information into first coded information, second coded information, quantized sub-band energies for each sub-band among a plurality of sub-bands, and an analysis result for a tonality calculated for each sub-band among the plurality of sub-bands; selecting a second sub-band from among the plurality of sub-bands on the basis of the analysis result for the tonality and the quantized sub-band energy; determining a first number of bits to be allocated to a first sub-band among the plurality of sub-bands; generating a first decoded spectrum by decoding the first coded information using the first number of bits; generating a second decoded spectrum using decoding the second coded information, and generating a reconstructed spectrum by combining the second decoded spectrum and the first decoded spectrum; and generating and outputting an output audio signal by performing a transform on the reconstructed spectrum into a time domain; when said computer program is run by a computer.

One non-limiting and exemplary embodiment provides a coding technique and a decoding technique for realizing high-quality audio signals while reducing the overall bit rate.

In one general aspect, the techniques disclosed here feature an audio signal coding apparatus including a time-frequency transformer, a sub-band energy quantizer, a tonality calculator, a bit allocator, and a multiplexer. The time-frequency transformer generates a spectrum by performing a transform on an input audio signal into a frequency domain, divides the spectrum into sub-bands, which are predetermined frequency bands, and outputs sub-band spectra. The sub-band energy quantizer obtains, for each of the sub-bands, quantized sub-band energy. The tonality calculator analyzes tonality of the sub-band spectra and outputs an analysis result. The bit allocator selects a second sub-band on which quantization is performed by a second quantizer from among the sub-bands on the basis of the analysis result of the tonality and the quantized sub-band energy, and determines a first number of bits to be allocated to a first sub-band, among the sub-bands, on which quantization is performed by a first quantizer. The multiplexer multiplexes into information coded information output from the first quantizer and from the second quantizer, the quantized sub-band energy, and the analysis result of the tonality, and outputs the multiplexed information. The first quantizer codes a sub-band spectrum among the sub-band spectra that is included in the first sub-band by first coding method using the first number of bits, and the second quantizer codes a sub-band spectrum among the sub-band spectra that is included in the second sub-band by using a second coding method.

With the coding apparatus, decoding apparatus, and so on according to the present disclosure, it is possible to code and decode high-quality audio signals while reducing the overall bit rate.

It should be noted that general or specific embodiments may be implemented as a system, a method, an integrated circuit, a computer program, a storage medium, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

BRIEF DESCRIPTION OF THE DRAWINGS

Embodiments of the present invention will be detailed subsequently referring to the appended drawings, in which.

DETAILED DESCRIPTION OF THE INVENTION

Hereinafter, configurations and operations in embodiments of the present disclosure will be described with reference to the drawings. Audio signals, which are input signals to a coding apparatus of the present disclosure and output signals from a decoding apparatus of the present disclosure, conceptually include speech signals, music signals having a wider band, and signals in which these types of signals are mixed.

In the present disclosure, "input audio signals" conceptually include music signals, speech signals, and signals in which both types of signals are mixed. The term "quantized sub-band energy" means energy obtained by quantizing energy of a sub-band, which is the sum or average of energy of sub-band spectra in a sub-band, and energy of a sub-band can be obtained by calculating the square sum of sub-band spectra in the sub-band, for example. The term "tonality" means the degree to which a spectral peak is produced in a specific frequency component, and the result of analyzing tonality can be represented by a numerical value, a coding, or the like. The term "pulse coding" means coding in which a spectrum is approximately represented using pulses.

The term "relatively low" means a case of being lower as a result of a comparison between sub-bands and corresponds to a case of being lower than the average of all sub-bands or a case of being lower than a predetermined value. The term "sub-band in a high-frequency range" means a sub-band that is positioned closer to a high-frequency side among a plurality of sub-bands.

Note that a first (spectrum) quantizer, a second (spectrum) quantizer, a first (spectrum) decoder, a second (spectrum) decoder, a first sub-band, a second sub-band, a third sub-band, a fourth sub-band, a first number of bits, a second number of bits, a third number of bits, and a fourth number of bits described in the embodiments and claims are distinguished from each other to represent not the order thereof but their categories.

First Embodiment

Figure 1:
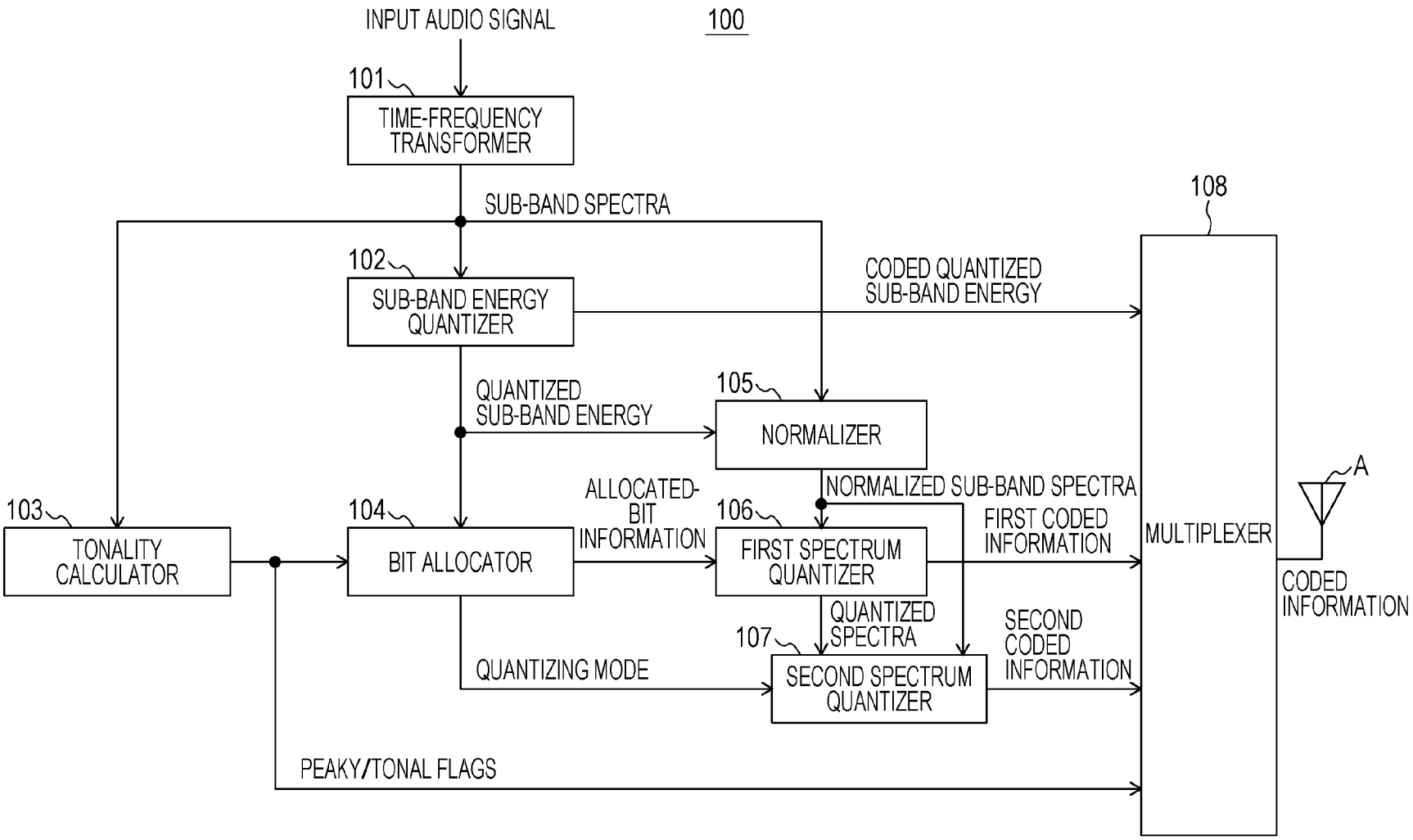
FIG. 1 is a block diagram of a coding apparatus according to a first embodiment of the present disclosure.

FIG. 1 is a block diagram illustrating a configuration and an operation of an audio signal coding apparatus 100 according to a first embodiment. The audio signal coding apparatus 100 illustrated in FIG. 1 includes a time-frequency transformer 101, a sub-band energy quantizer 102, a tonality calculator 103, a bit allocator 104, a normalizer 105, a first spectrum quantizer 106, a second spectrum quantizer 107, and a multiplexer 108. To the multiplexer 108, an antenna A is connected. The audio signal coding apparatus 100 and the antenna A together constitute a terminal apparatus or a base station apparatus.

The time-frequency transformer 101 performs a transform on an input audio signal in a time domain into a frequency domain and generates an input audio signal spectrum (hereinafter referred to as "spectrum"). The time-frequency transform is performed by using MDCT (modified discrete cosine transform), for example, but is not limited to this transform. The time-frequency transform may be performed by using DCT (discrete cosine transform), DFT (discrete Fourier transform), or Fourier transform, for example.

The time-frequency transformer 101 divides the spectrum into sub-bands, which are predetermined frequency bands. The predetermined frequency bands may be spaced at equal intervals or may be spaced at different intervals, specifically, at long intervals in a high-frequency range and at short intervals in a low-frequency range, for example.

The time-frequency transformer 101 outputs spectra obtained by division into the sub-bands to the sub-band energy quantizer 102, to the tonality calculator 103, and to the normalizer 105 as sub-band spectra.

The sub-band energy quantizer 102 obtains, for each sub-band, sub-band energy, which is energy of the sub-band spectrum, quantizes the sub-band energy, and obtains quantized sub-band energy. Specifically, the sub-band energy can be obtained by calculating the square sum of sub-band spectra in the sub-band; however, the calculation is not limited to this. The sub-band energy can be obtained by performing integration on the amplitudes of sub-band spectra for each sub-band, for example. In a case of averaging the sub-band energy, the square sum is divided by the number of spectra (sub-band width) in the sub-band. The sub-band energy thus obtained is quantized in accordance with a predetermined step width.

The sub-band energy quantizer 102 outputs the obtained quantized sub-band energy to the normalizer 105 and to the bit allocator 104 and outputs coded quantized sub-band energy obtained by coding the quantized sub-band energy to the multiplexer 108.

The tonality calculator 103 analyzes sub-band spectra included in each sub-band and determines tonality of the sub-band. Tonality is the degree to which a spectral peak is produced in a specific frequency component and conceptually includes peakiness, which means that a noticeable peak is present. Tonality can be quantitatively obtained by calculating the ratio between the amplitude of the average spectrum in a target sub-band and the amplitude of the maximum spectrum present in the sub-band, for example. It is defined that the spectra of the sub-band have tonality (peakiness) if the obtained value exceeds a predetermined threshold. In this embodiment, the tonality calculator 103 generates a peaky/tonal flag set to one if the obtained value exceeds the predetermined value or generates a peaky/tonal flag set to zero if the obtained value is equal to or smaller than the predetermined threshold, and outputs the peaky/tonal flag to the bit allocator 104 and to the multiplexer 108 as an analysis result. The tonality calculator 103 may output as an analysis result the above-described ratio as is.

The tonality calculator is effective as follows.

Under a low-bit rate condition, in order to efficiently quantize a spectrum in which the spectral energy is distributed throughout a sub-band, such as a noise-like spectrum, a method based on a pitch filter (that is, a method in which a high-frequency-range spectrum is expressed by using a low-frequency-range spectrum) is effective. Therefore, the degree of energy distribution within a sub-band is determined from the measure of peakiness/tonality (the ratio between the peak power and the average power or the like) of the spectrum in the sub-band, and if the peakiness/tonality of the spectrum is not high, the sub-band is subjected to quantization based on a pitch filter.

The bit allocator 104 refers to the quantized sub-band energy and the peaky/tonal flag of each sub-band and allocates bits from a bit budget, which corresponds to the total number of bits available for coding, to the sub-band spectrum in each sub-band. Specifically, the bit allocator 104 calculates and determines a first number of bits, which is the number of bits to be allocated to first sub-bands, which are sub-bands on which quantization is performed by the first spectrum quantizer, and outputs the result to the first spectrum quantizer 106 as allocated-bit information. Further, the bit allocator 104 selects and identifies second sub-bands, which are sub-bands on which quantization is performed by the second spectrum quantizer 107, and outputs the result to the second spectrum quantizer 107 as a quantizing mode.

The configuration and operation of the bit allocator 104 are described in detail below.

Note that, in this embodiment, the bit allocator 104 refers to the peaky/tonal flag and the quantized sub-band energy of each sub-band in this order; however, the order of reference may be any order.

Regarding the second sub-bands, which are subjected to quantization by the second spectrum quantizer 107, sub-bands in the entire band may be candidate second sub-bands. In general, a band having low quantized sub-band energy and a band having low tonality are mainly present in a high-frequency range, and therefore, only sub-bands present in a specific high-frequency range may be targeted. For example, only four or five sub-bands in a high-frequency range may be targeted.

An audio signal usually has high tonality in a low-frequency range and low tonality in a high-frequency range, and therefore, sub-bands in a high-frequency range are substantially subjected to quantization based on a pitch filter. Accordingly, an alternative method may be employed in which all sub-bands in a higher-frequency range than a sub-band selected on the basis of tonality may be subjected to quantization based on a pitch filter, and only the sub-band numbers may be transmitted as the quantizing mode.

The normalizer 105 normalizes (divides) each sub-band spectrum by the input quantized sub-band energy to generate a normalized sub-band spectrum. As a result, the difference in the magnitude of the amplitude between the sub-bands is normalized. The normalizer 105 outputs the normalized sub-band spectrum to the first spectrum quantizer 106 and to the second spectrum quantizer 107.

Note that the normalizer 105 may have any configuration.

Although the normalizer 105 is configured as one component in this embodiment, the normalizer 105 may be provided in the preceding stage of the first spectrum quantizer 106 and in the preceding stage of the second spectrum quantizer 107, that is, may be configured as two components.

The first spectrum quantizer 106 is an example of a first quantizer and quantizes sub-band spectra belonging to the first sub-bands on which quantization is to be performed by the first spectrum quantizer 106 among the input normalized sub-band spectra by using the first number of bits allocated by the bit allocator 104. The first spectrum quantizer 106 outputs the result of quantization to the second spectrum quantizer 107 as quantized spectra and outputs first coded information obtained by coding the quantized spectra to the multiplexer 108.

The first spectrum quantizer 106 uses a pulse coder (first coding method). Examples of the pulse coder include a lattice vector quantizer that performs lattice vector quantization and a pulse coder that performs pulse coding in which a sub-band spectrum is approximately represented by a small number of pulses. That is, any quantizer may be used as long as the quantizer employs a quantization method suitable to quantization of a spectrum having high tonality or a quantization method using a small number of pulses.

Note that, at an extremely low bit rate, a higher effect of maintaining audio quality can be expected with quantization using pulse coding in which a sub-band spectrum is approximately represented by a small number of pulses than with lattice vector quantization.

The second spectrum quantizer 107 is an example of a second quantizer and can employ a quantization method using an extended band (prediction model using a pitch filter: second coding method) as described below, for example.

Here, a pitch filter is a processing block that performs a process represented by expression 1 below.

$$y[i]=x[i]+\beta\times y[i-T] \quad (1)$$

In general, a pitch filter refers to a filter that emphasizes a pitch cycle (T) for a signal on a time axis (emphasizes a pitch component on a frequency axis) and is, for example, a digital filter represented by expression 1 for a discrete signal x[i] if the number of taps is one. However, a pitch filter in this embodiment is defined as a processing block that performs a process represented by expression 1 and does not necessarily perform pitch emphasizing on a signal on the time axis.

In this embodiment, the pitch filter (processing block represented by expression 1) is applied to a quantization MDCT coefficient sequence Mq[i]. Specifically, in expression 1, settings, specifically, x[i]=0 ($i\geq K$, where K is the lower frequency limit of the MDCT coefficient that is subjected to coding) and y[i]=Mq[i] ($i<K$), are made, and y[i] ($K\leq i\leq K'$, where K' is the upper frequency limit of the MDCT coefficient that is subjected to coding) is calculated. A value T with which the error between the MDCT coefficient Mt[i] that is subjected to coding and the calculated y[i] is minimized is coded as lag information. Such spectrum coding based on a pitch filter is disclosed by International Publication No. 2005/027095, for example.

The second spectrum quantizer 107 refers to the quantizing mode and identifies the second sub-bands (normalized sub-band spectra) on which quantization is to be performed by the second spectrum quantizer 107. As a result, the values of the above described K and K' are identified. Then, the sub-band or band of a quantized spectrum for which the normalized sub-band spectrum (corresponding to the above-described Mt[i], where $K\leq i\leq K'$) relating to the identified second sub-bands (a frequency ranging from K to K') has the maximum correlation with a quantized spectrum (corresponding to the above-described Mq[i], where $i<K$) is searched for, and the position of the sub-band or band is used to generate lag information (corresponding to the above-described T). Examples of the lag information include the absolute position or relative position of the sub-band or band, or the sub-band number. The second spectrum quantizer 107 codes and outputs the lag information to the multiplexer 108 as second coded information.

Note that, in this embodiment, the coded quantized sub-band energy is multiplexed and transmitted by the multiplexer 108, and a gain can be generated by a decoder. Therefore, a gain is not coded. However, a gain may be coded and transmitted. In this case, a gain between the second sub-bands on which quantization is to be performed and the sub-band of a quantized spectrum that has the maximum correlation is calculated, and the second spectrum quantizer 107 codes and outputs the lag information and the gain to the multiplexer 108 as the second coded information.

Note that, in general, the bandwidth of a sub-band in a high-frequency range is set wider than a sub-band in a low-frequency range. However, some sub-bands in a low-frequency range subjected to copying have low energy and might not be subjected to lattice vector quantization. In this case, such sub-bands may be assumed to be zero spectra, or noise may be added to avoid a sudden spectral change between sub-bands.

The multiplexer 108 multiplexes and outputs the coded quantized sub-band energy, the first coded information, the second coded information, and the peaky/tonal flags to the antenna A as coded information.

The antenna A transmits the coded information to an audio signal decoding apparatus. The coded information reaches the audio signal decoding apparatus via various nodes and base stations.

Now, the bit allocator 104 is described in detail below.

Figure 2:
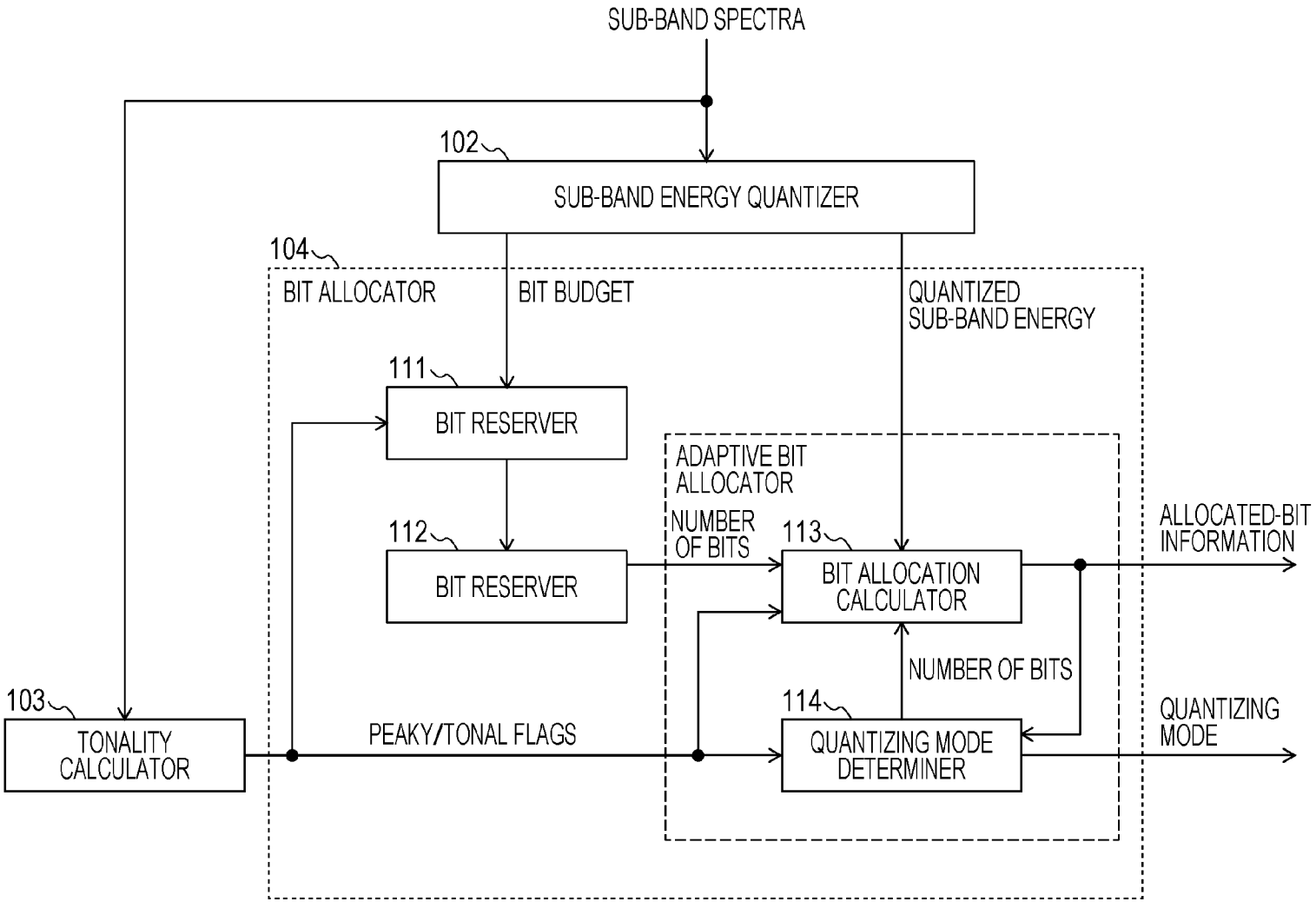
FIG. 2 is a detailed block diagram of a bit allocator of the coding apparatus according to the first embodiment of the present disclosure.

FIG. 2 is a block diagram illustrating a detailed configuration and an operation of the bit allocator 104 of the audio signal coding apparatus 100 according to the first embodiment. The bit allocator 104 illustrated in FIG. 2 includes a bit reserver 111, a bit reserver 112, a bit allocation calculator 113, and a quantizing mode determiner 114.

The bit reserver 111 refers to the peaky/tonal flags that are output from the tonality calculator 103 and reserves a number of bits needed for second spectrum quantization performed by the second spectrum quantizer 107 if any of the peaky/tonal flags is set to zero.

In this embodiment, a number of bits needed for coding lag information are reserved on the basis of a pitch filter. The reserved number of bits are excluded from the bit budget, which corresponds to the total number of bits available for quantization, and the remaining bit budget is output to the bit reserver 112. Note that the bit budget is supplied by the sub-band energy quantizer 102, which means that bits that remain after excluding the number of bits needed for variable coding of quantized sub-band energy are available to the first spectrum quantizer 106, to the second spectrum quantizer 107, and for quantization (coding) of the peaky/tonal flags. The sub-band energy quantizer 102 does not necessarily generate information about the bit budget.

The bit reserver 112 reserves a number of bits used for the peaky/tonal flags. In this embodiment, the peaky/tonal flags are transmitted by using five sub-bands in a high-frequency range, and therefore, the bit reserver 112 reserves five bits, for example.

The bit reserver 112 outputs, to the bit allocation calculator 113, which is in an adaptive bit allocator, a number of bits that remain after excluding the number of bits reserved by the bit reserver 112 from the bit budget input from the bit reserver 111. The sum of the number of bits reserved by the bit reserver 111 and the number of bits reserved by the bit reserver 112 corresponds to a third number of bits. A sub-band for which the peaky/tonal flag is set to zero corresponds to a third sub-band.

Note that the order of the bit reserver 111 and the bit reserver 112 may be changed. In this embodiment, the bit reserver 111 and the bit reserver 112 are separated blocks; however, operations of these reservers may be performed simultaneously in a single block. Alternatively, the operations may be performed within the bit allocation calculator 113.

The bit allocation calculator 113 calculates a bit allocation to a sub-band on which quantization is performed by the first spectrum quantizer 106. Specifically, the bit allocation calculator 113 first allocates the number of bits output from the bit reserver 112 to each sub-band while referring to the quantized sub-band energy. The allocation is performed with a method described in the related art section in which determination as to whether a sub-band is essential for hearing is performed on the basis of the magnitude of the quantized sub-band energy, a sub-band that is determined to be essential is given priority, and bit allocation is performed on the sub-band. As a result, no bit is allocated to a sub-band having quantized sub-band energy equal to zero, lower than zero, or lower than a predetermined value.

Upon allocation, the bit allocation calculator 113 refers to the input peaky/tonal flags and excludes sub-bands (third sub-bands) for which the peaky/tonal flags are set to zero from bit allocation. That is, the bit allocation calculator 113 identifies only sub-bands having high peakiness (sub-bands for which the peaky/tonal flags are set to one) to be target sub-bands for bit allocation and allocates bits to the sub-bands. The bit allocation calculator 113 identifies sub-bands (first sub-bands) to which bits are to be allocated, creates allocated-bit information that indicates the number of bits to be allocated to the sub-bands, and outputs the information to the quantizing mode determiner 114 first.

The quantizing mode determiner 114 receives the allocated-bit information output from the bit allocation calculator 113 and the peaky/tonal flags. In a case where a sub-band in a high-frequency range that has high tonality (that is subjected to quantization by the first spectrum quantizer 106) and that has been allocated no bit is present, the quantizing mode determiner 114 redefines the sub-band as a sub-band (fourth sub-band) on which quantization is performed by the second spectrum quantizer 107 and outputs a number of bits (fourth number of bits) needed for quantization by the second spectrum quantizer to the bit allocation calculator 113 in order to subtract the number of bits from the allocated-bit information. That is, the quantizing mode determiner 114 allocates the number of bits needed for quantization by the second spectrum quantizer 107 to the band of interest and outputs the number of allocated bits (fourth number of bits). Alternatively, the quantizing mode determiner 114 may subtract the number of allocated bits from the bit budget available to the first spectrum quantizer 106 and output the result to the bit allocation calculator 113.

The quantizing mode determiner 114 identifies sub-bands on which quantization is performed by the second spectrum quantizer 107 and outputs the result to the second spectrum quantizer 107 as a quantizing mode. Specifically, the quantizing mode determiner 114 specifies sub-bands (third sub-bands) in a high-frequency range that have low tonality (for which the peaky/tonal flags are set to zero) and sub-bands (fourth sub-bands) in a high-frequency range to which no bit has been allocated as sub-bands (second sub-bands) on which quantization is performed by the second spectrum quantizer 107 and outputs the sub-bands as the quantizing mode.

Again, the bit allocation calculator 113 updates the bit budget by subtracting the number of bits (fourth number of bits) received from the quantizing mode determiner 114 from the number of bits (bit budget) input from the bit reserver 112 and recalculates the bit allocation to a sub-band on which quantization is performed by the first spectrum quantizer 106. In a case of receiving the updated bit budget from the quantizing mode determiner, the bit allocation calculator 113 recalculates the bit allocation to a sub-band on which quantization is performed by the first spectrum quantizer 106 by using the updated bit budget. Consequently, the first number of bits is equal to a value obtained by subtracting the third number of bits and the fourth number of bits from the total number of bits (bit budget).

The bit allocation calculator 113 outputs the number of bits (first number of bits) obtained after recalculation and information about sub-bands (first sub-bands) on which quantization is performed by the first spectrum quantizer 106 to the first spectrum quantizer 106 this time as allocated-bit information.

In a case where recalculation need not be performed because all sub-bands are allocated bits as a result of first calculation of the bit allocation by the bit allocation calculator 113, for example, the bit allocation calculator 113 may output the allocated-bit information directly to the first spectrum quantizer 106.

Figure 3:
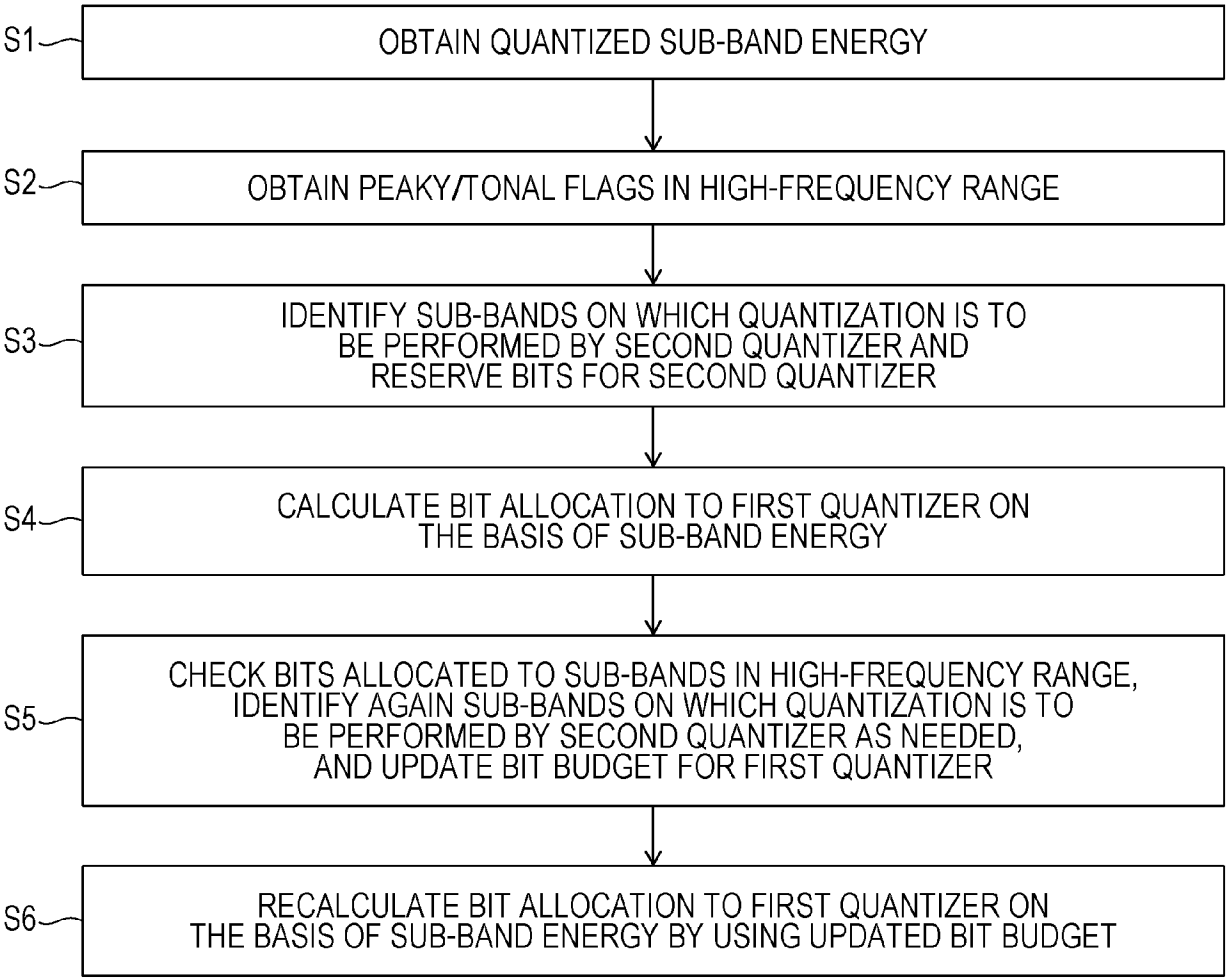
FIG. 3 is a diagram for describing an operation performed by the coding apparatus according to the first embodiment of the present disclosure.

FIG. 3 is a flowchart of an operation performed by the audio signal coding apparatus 100 according to the first embodiment, specifically, an operation performed by the bit allocator 104.

First, the bit allocator 104 obtains quantized sub-band energy from the sub-band energy quantizer 102 (S1).

Next, the bit allocator 104 obtains peaky/tonal flags in a high-frequency range from the tonality calculator 103 (S2).

The bit allocator 104 thereafter identifies sub-bands (third sub-bands) on which quantization is to be performed by the second spectrum quantizer 107 on the basis of the peaky/tonal flags, and the bit reserver 111 and the bit reserver 112 therein reserve bits (third number of bits) used in quantization by the second spectrum quantizer 107 (S3).

The bit allocation calculator 113 in the bit allocator 104 determines a number of bits to be allocated to sub-bands that are subjected to quantization by the first spectrum quantizer 106 on the basis of the quantized sub-band energy (S4).

The quantizing mode determiner 114 in the bit allocator 104 checks the number of bits allocated to sub-bands in a high-frequency range determined by the bit allocation calculator 113, identifies again sub-bands (second sub-bands) on which quantization is to be performed by the second spectrum quantizer 107 as needed, and updates the bit budget for the first spectrum quantizer 106 (S5).

Last, the bit allocation calculator 113 in the bit allocator 104 recalculates the bit allocation (first number of bits) to the first spectrum quantizer 106 by using the updated bit budget (S6).

With the audio signal coding apparatus according to this embodiment, it is possible to realize coding of high-quality audio signals while reducing the overall bit rate.

Specifically, with the configurations and operations in FIG. 2 and FIG. 3, it is possible to realize bit allocation that does not produce a sub-band on which quantization is not performed (the number of allocated bits becomes zero) in a high-frequency range in which the sub-band width is specifically wide and that maximizes the number of sub-bands on which quantization is performed by the first quantizer. Accordingly, it is possible to realize adaptive bit allocation that can attain the best performance at a limited bit rate.

Second Embodiment

Figure 4:
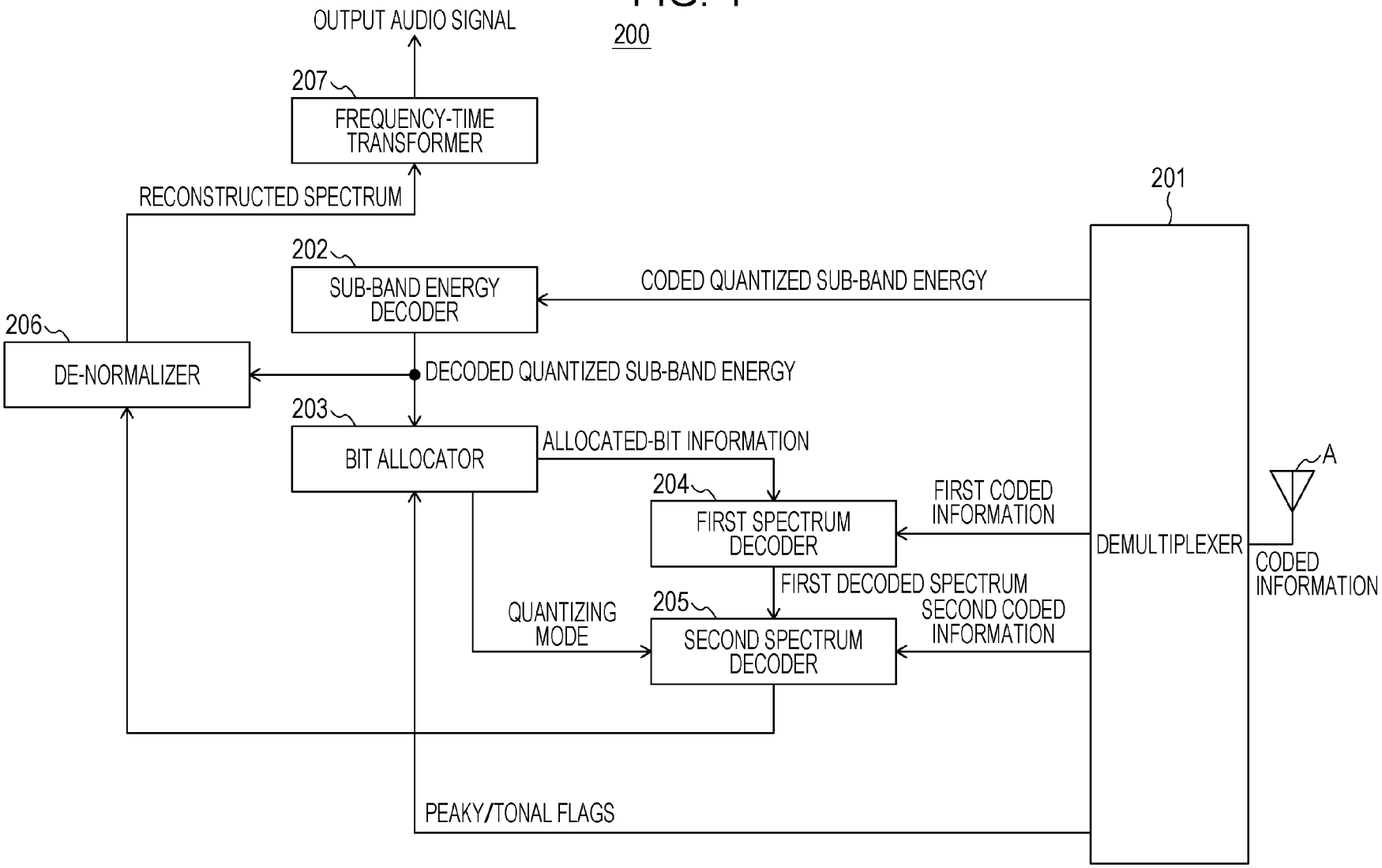
FIG. 4 is a block diagram of a decoding apparatus according to a second embodiment of the present disclosure.

FIG. 4 is a block diagram illustrating a configuration and an operation of an audio signal decoding apparatus 200 according to a second embodiment. The audio signal decoding apparatus 200 illustrated in FIG. 4 includes a demultiplexer 201, a sub-band energy decoder 202, a bit allocator 203, a first spectrum decoder 204, a second spectrum decoder 205, a de-normalizer 206, and a frequency-time transformer 207. To the demultiplexer 201, an antenna A is connected. The audio signal decoding apparatus 200 and the antenna A together constitute a terminal apparatus or a base station apparatus.

The demultiplexer 201 receives coded information received by the antenna A and demultiplexes the coded information into coded quantized sub-band energy, first coded information, second coded information, and peaky/tonal flags. The demultiplexer 201 outputs the coded quantized sub-band energy to the sub-band energy decoder 202, the first coded information to the first spectrum decoder 204, the second coded information to the second spectrum decoder 205, and the peaky/tonal flags to the bit allocator 203.

The sub-band energy decoder 202 decodes the coded quantized sub-band energy, generates decoded quantized sub-band energy, and outputs the decoded quantized sub-band energy to the bit allocator 203 and to the de-normalizer 206.

The bit allocator 203 refers to the decoded quantized sub-band energy of each sub-band and the peaky/tonal flags and determines allocation of bits that are allocated by the first spectrum decoder 204 and those that are allocated by the second spectrum decoder 205. Specifically, the bit allocator 203 determines a number of bits (first number of bits) to be allocated in decoding of the first coded information by the first spectrum decoder 204 and sub-bands (first sub-bands) to which the bits are allocated and outputs the result as allocated-bit information. Further, the bit allocator 203 identifies and selects sub-bands (second sub-bands) for which the second coded information is to be decoded by the second spectrum decoder 205 and outputs the result to the second spectrum decoder 205 as a quantizing mode.

Figure 5:
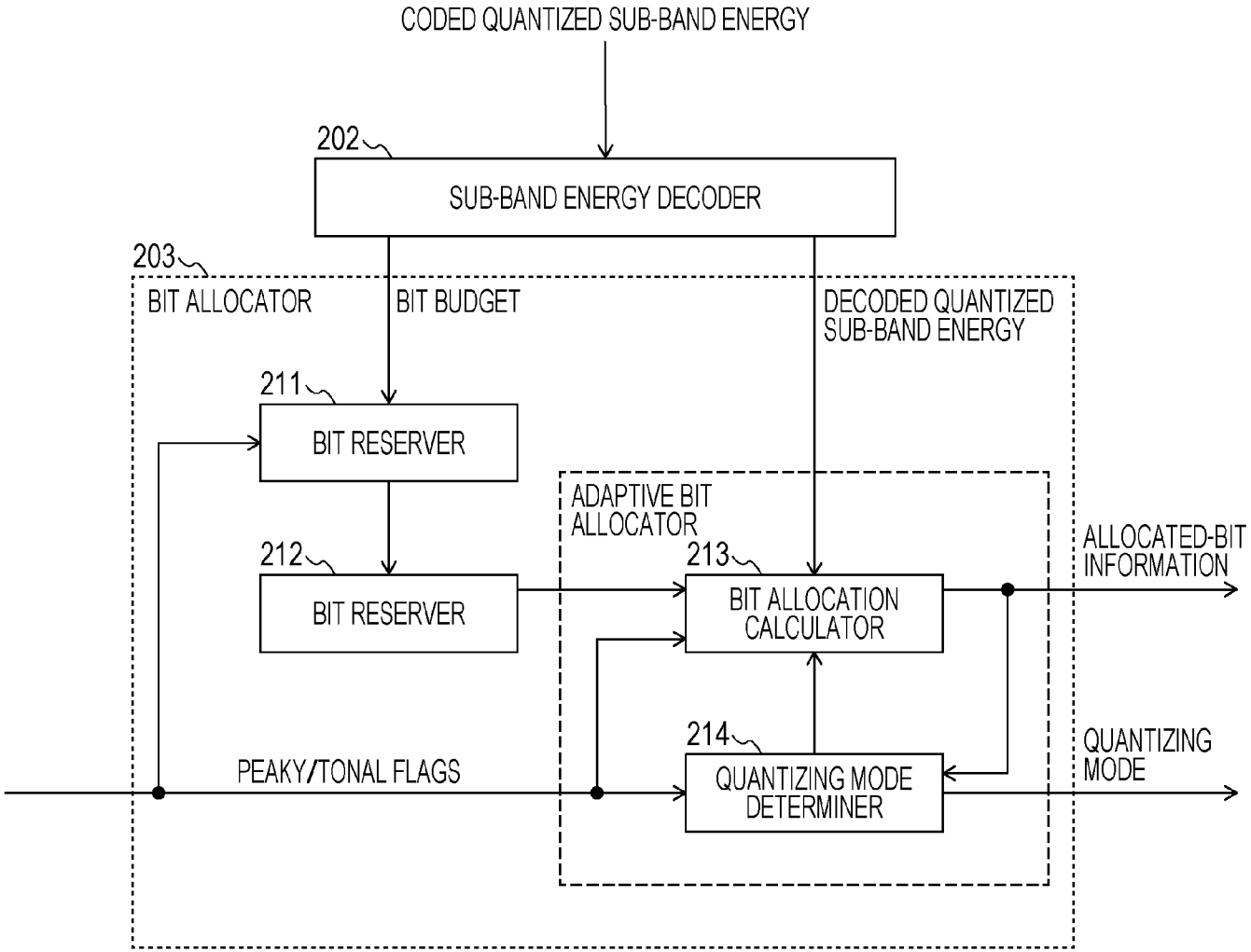
FIG. 5 is a detailed block diagram of a bit allocator of the decoding apparatus according to the second embodiment of the present disclosure.
Figure 6:
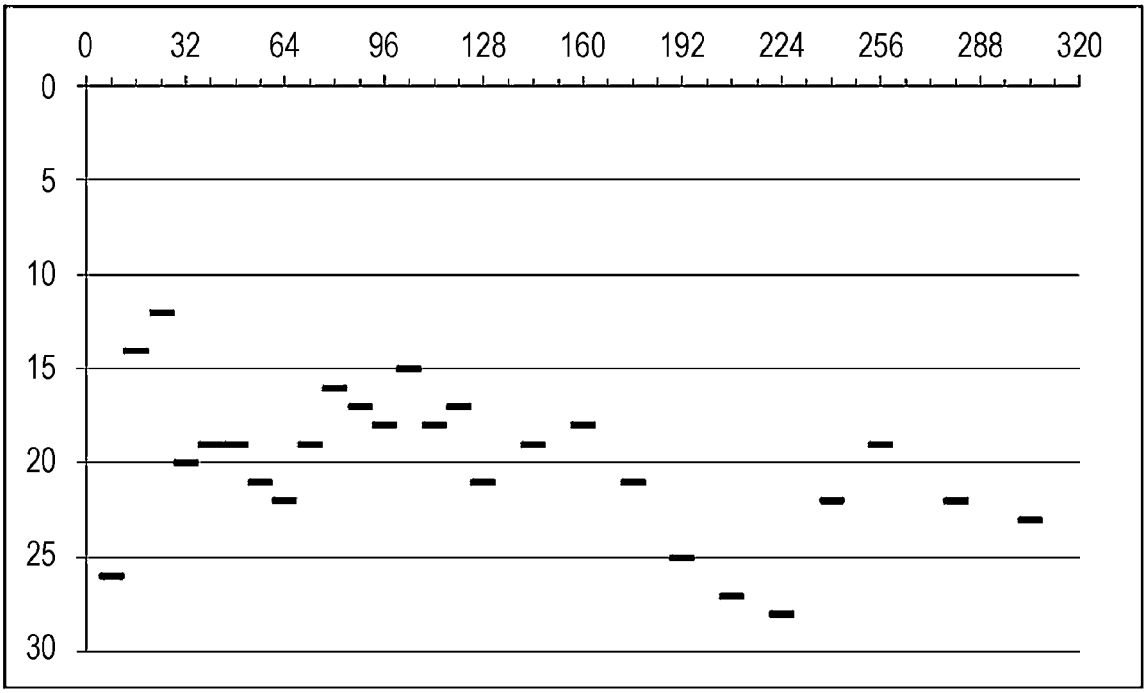
FIG. 6 is a diagram for describing sub-band energy in a coding apparatus according to the related art.
Figure 7:
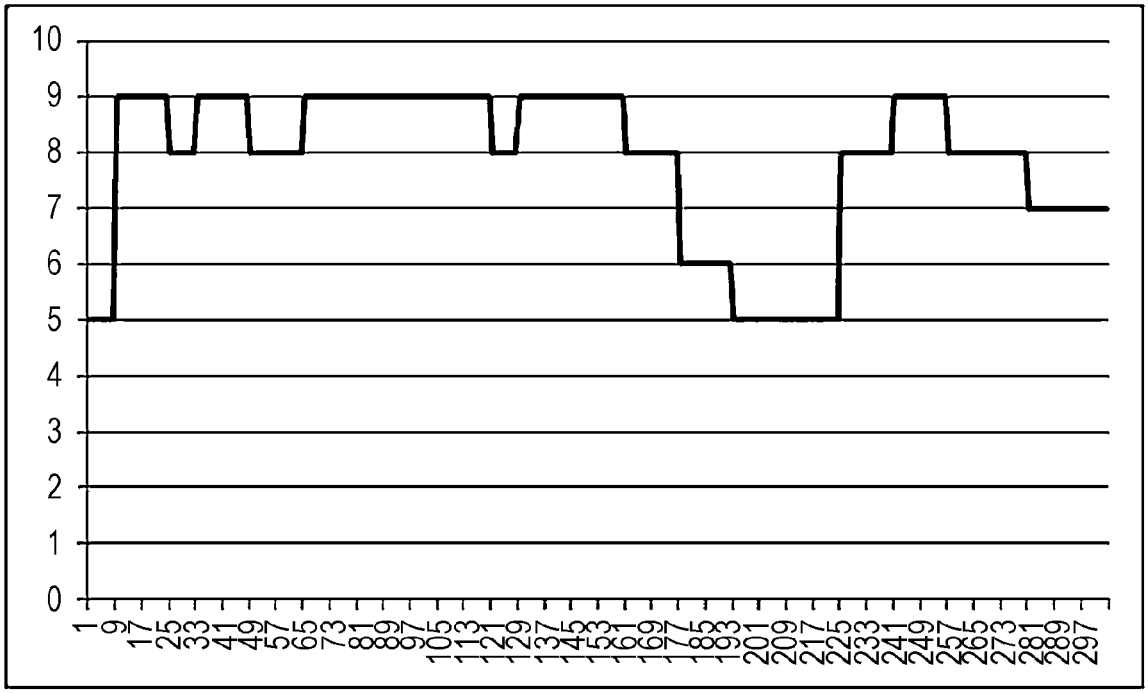
FIG. 7 is a diagram for describing the result of bit allocation to sub-bands in a coding apparatus according to the related art.
Figure 8:
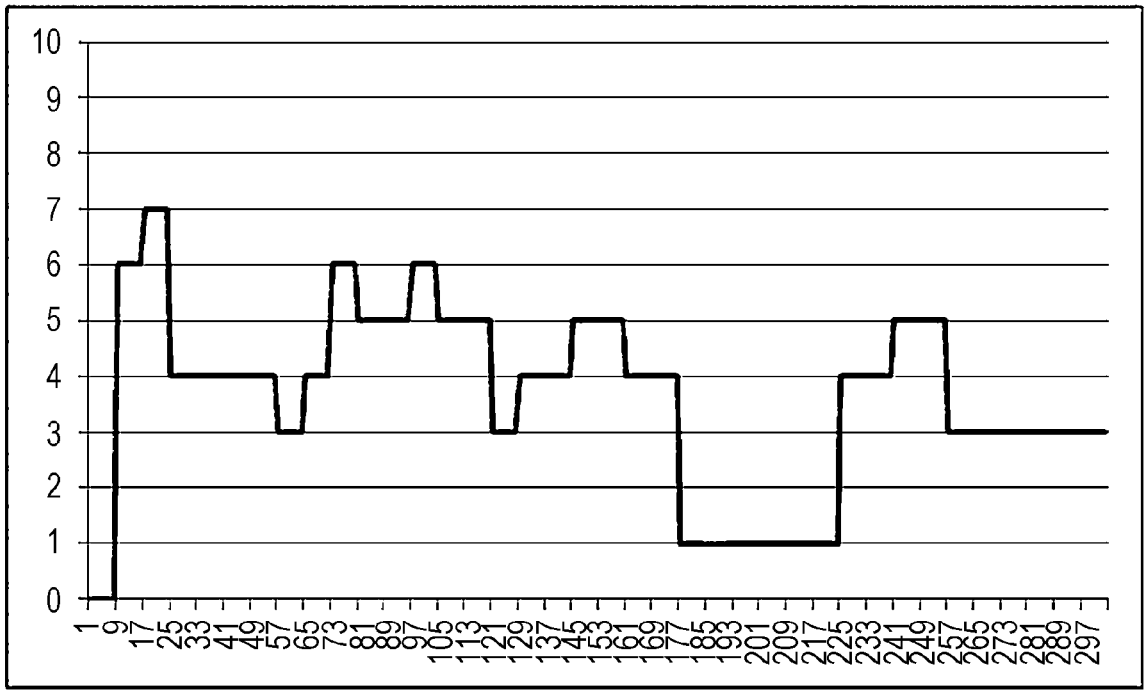
FIG. 8 is a diagram for describing the result of bit allocation to sub-bands in a coding apparatus according to the related art.
Figure 9:
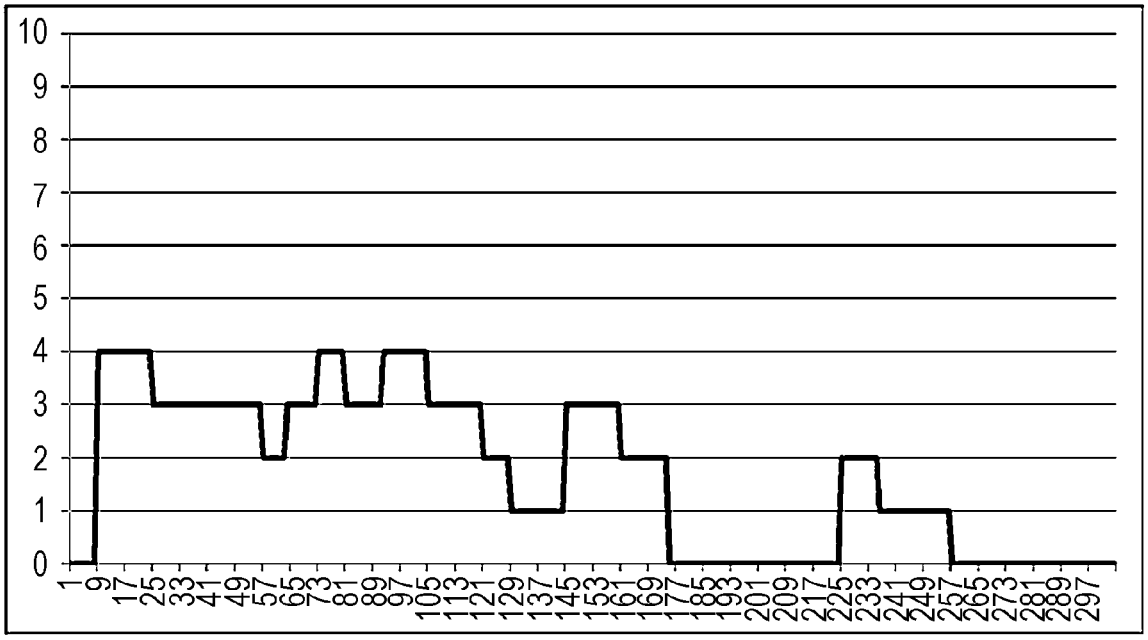
FIG. 9 is a diagram for describing the result of bit allocation to sub-bands in a coding apparatus according to the related art.

The bit allocator 203 has the same configuration and performs the same operation as in the bit allocator 104 illustrated in FIG. 5 and described in the description of the coding apparatus. Therefore, for the details of the operation, refer to the description of the bit allocator 104 in the coding apparatus.

The first spectrum decoder 204 decodes the first coded information by using the first number of bits indicated by the allocated-bit information, generates a first decoded spectrum, and outputs the first decoded spectrum to the second spectrum decoder 205.

The second spectrum decoder 205 uses the first decoded spectrum for the sub-bands identified with the quantizing mode, decodes the second coded information, generates a second decoded spectrum, generates a reconstructed spectrum by combining the second decoded spectrum with the first decoded spectrum, and outputs the reconstructed spectrum.

The de-normalizer 206 adjusts the amplitude (gain) of the reconstructed spectrum while referring to the decoded quantized sub-band energy and outputs the result to the frequency-time transformer 207.

The frequency-time transformer 207 transforms the reconstructed spectrum in a frequency domain into an output audio signal in a time domain and outputs the output audio signal. Examples of the frequency-time transform include a transform that is the inverse of the transform described in the description of the time-frequency transform.

With the audio signal decoding apparatus according to this embodiment, it is possible to realize decoding of high-quality audio signals while reducing the overall bit rate.

CONCLUSION

The audio signal coding apparatus and the audio signal decoding apparatus according to the present disclosure have been described in the first and second embodiments. The coding apparatus and the decoding apparatus according to the present disclosure may conceptually be in the form of a semi-finished product or a component, such as a system board or a semiconductor device, or in the form of a finished product, such as a terminal apparatus or a base station apparatus. In the case where the coding apparatus and the decoding apparatus according to the present disclosure are in the form of a semi-finished product or a component, the coding apparatus and the decoding apparatus are combined with an antenna, a DA/AD converter, an amplifier, a speaker, a microphone, and so on to form a finished product.

Note that the block diagrams in FIG. 1, FIG. 2, FIG. 4, and FIG. 5 illustrate the configurations and operations (methods) of the exclusively designed hardware devices and may be applicable to a case where a program for performing the operations (methods) of the present disclosure is installed on a general-purpose hardware device and executed by a processor to thereby implement the operations (methods). Examples of the general-purpose hardware device, which is a computer, include various portable information terminals, such as a personal computer and a smartphone, and various portable phones.

Examples of the exclusively designed hardware devices include not only finished products (consumer electronic products), such as a portable phone and a fixed phone, but also semi-finished products and components, such as a system board and a semiconductor device.

The audio signal coding apparatus and the audio signal decoding apparatus according to the present disclosure are applicable to a machine or a component involved in recording, transmission, and reproduction of audio signals.

Additional embodiments and aspects of the invention will be described which can be used individually or in combination with the features and functionalities described herein.

According to an aspect, an audio signal coding apparatus comprises: a memory that stores instructions; and a processor that, when executing the instructions stored in the memory, performs operations comprising: generating a spectrum by performing a transform on an input audio signal into a frequency domain, dividing the spectrum into sub-bands, which are predetermined frequency bands, and outputs sub-band spectra; obtaining, for each of the sub-bands, quantized sub-band energy; analyzing tonality of the sub-band spectra and outputs an analysis result; selecting a second sub-band on which quantization is performed by a second quantizer from among the sub-bands on the basis of the analysis result of the tonality and the quantized sub-band energy, and determining a first number of bits to be allocated to a first sub-band, among the sub-bands, on which quantization is performed by a first quantizer; and multiplexing into information coded information output from the first quantizer and from the second quantizer, the quantized sub-band energy, and the analysis result of the tonality, and outputting the multiplexed information, wherein the processor codes a sub-band spectrum among the sub-band spectra that is comprised by the first sub-band by a first coding method using the first number of bits, and codes a sub-band spectrum among the sub-band spectra that is comprised by the second sub-band by a second coding method.

According to a second aspect when referring back to the first aspect, the processor selects the second sub-band from among the sub-bands that are in a high-frequency range.

According to a third aspect when referring back to the first second, the processor selects a sub-band, among the sub-bands, in which the tonality is lower than a predetermined threshold as the second sub-band.

According to a fourth aspect when referring back to the second aspect, the processor selects a sub-band among the sub-bands that has the quantized sub-band energy equal to zero or lower than a predetermined value as the second sub-band.

According to a fifth aspect when referring back to the first aspect, the processor determines the first number of bits by subtracting a second number of bits to be allocated to the second sub-band from a total number of bits available for quantization.

According to a sixth aspect when referring back to the fifth aspect, the processor calculates a third number of bits, among the tonal number of bits, to be allocated to a third sub-band selected from among the sub-bands on the basis of the analysis result of the tonality, selects as a fourth sub-band a sub-band, among the sub-bands, to which no bit is allocated when a number of bits obtained by subtracting the third number of bits from the total number of bits are allocated to the first sub-band on the basis of the quantized sub-band energy, and calculates a fourth number of bits to be allocated in a case where coding is performed on the fourth sub-band, and selects the third sub-band and the fourth sub-band as other second sub-bands on which quantization is performed by the second quantizer, and determines a number of bits obtained by subtracting the third number of bits and the fourth number of bits from the total number of bits to be the first number of bits to be allocated to the first sub-band.

According to a seventh aspect when referring back to the first aspect, the analysis result is output as a flag indicating whether or not the tonality is higher than a predetermined threshold.

According to an eighth aspect when referring back to the first aspect, the first coding method is based on a pulse-coding in which sub-band spectrum being represented by a small number of pulses.

According to an ninth aspect when referring back to the first aspect, the second coding method is based on a pitch filter, the pitch filter being a method in which a high-frequency-range spectrum is expressed by using a low-frequency-range spectrum.

According to a tenth aspect, an audio signal decoding apparatus for decoding coded information output from an audio signal coding apparatus comprises: a memory that stores instructions; and a processor that, when executing the instructions stored in the memory, performs operations comprising: demultiplexing the coded information into first coded information, second coded information, quantized sub-band energy obtained by quantizing energy of each sub-band among sub-bands, and an analysis result of tonality calculated for each sub-band among the sub-bands; selecting a second sub-band on which decoding is performed by a second decoder from among the sub-bands on the basis of the analysis result of the tonality and the quantized sub-band energy, and determining a first number of bits to be allocated to a first sub-band, among the sub-bands, on which decoding is performed by a first decoder; and generating and outputting an output audio signal by performing a transform on a spectrum output from the second decoder into a time domain, wherein the first decoder generates a first decoded spectrum by decoding the first coded information using the first number of bits, and the second decoder generates a second decoded spectrum by decoding the second coded information, and generates a reconstructed spectrum by performing decoding using the second decoded spectrum and the first decoded spectrum.

According to an eleventh aspect, an audio signal coding method comprises: generating a spectrum by performing a transform on an input audio signal into a frequency domain; dividing the spectrum into sub-bands, which are predetermined frequency bands, and outputting sub-band spectra; obtaining, for each of the sub-bands, quantized sub-band energy; analyzing tonality of the sub-band spectra and outputting an analysis result; selecting a second sub-band from among the sub-bands on the basis of the analysis result of the tonality and the quantized sub-band energy; determining a first number of bits to be allocated to a first sub-band among the sub-bands; generating first coded information by coding a sub-band spectrum among the sub-band spectra that is comprised by the first sub-band by a first coding method using the first number of bits; generating second coded information by coding a sub-band spectrum among the sub-band spectra that is comprised by the second sub-band by using a second coding method; and multiplexing together and outputting the first coded information and the second coded information.

According to a twelfth aspect, an audio signal decoding method for decoding coded information output from an audio signal coding apparatus comprises: demultiplexing the coded information into first coded information, second coded information, quantized sub-band energy obtained by quantizing energy of each sub-band among sub-bands, and an analysis result of tonality calculated for each sub-band among the sub-bands; selecting a second sub-band from among the sub-bands on the basis of the analysis result of the tonality and the quantized sub-band energy; determining a first number of bits to be allocated to a first sub-band among the sub-bands; generating a first decoded spectrum by decoding the first coded information using the first number of bits; generating a second decoded spectrum by decoding the second coded information, and generating a reconstructed spectrum by performing decoding using the second decoded spectrum and the first decoded spectrum; and generating and outputting an output audio signal by performing a transform on the reconstructed spectrum into a time domain.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An audio signal coding apparatus comprising: a memory, at least a processor;

a time-frequency transformer that generates a spectrum comprising performing a transform on an input audio signal into a frequency domain, divides the spectrum into a plurality of sub-bands, which are predetermined frequency bands, and outputs sub-band spectral samples;

a sub-band energy quantizer that acquires, for each of the plurality of sub-bands, a quantized sub-band energy;

a tonality calculator that analyzes a tonality of the sub-band spectral samples and outputs an analysis result;

a bit allocator that selects one or more second sub-bands on which a quantization is performed by a second quantizer from among the plurality of sub-bands on the basis of the analysis result for the tonality and the quantized sub-band energies, and determines a first number of bits to be allocated to one or more first sub-bands, among the plurality of sub-bands, on which the quantization is performed by a first quantizer; and a multiplexer that multiplexes information output from the first quantizer and from the second quantizer, the quantized sub-band energies, and the analysis result of the tonality, and outputs the multiplexed information, wherein the first quantizer codes a sub-band spectral sample among the sub-band spectral samples that is comprised by the one or more first sub-bands by a first coding method using the first number of bits, and the second quantizer codes a sub-band spectral sample among the sub-band spectral samples that is comprised by the one or more second sub-bands by a second coding method to acquire the coded information output from the second quantizer, wherein the second coding method is configured for calculating lag information for the one or more second sub-bands, wherein the bit allocator determines a provisional first number of bits by subtracting a provisional second number of bits to be allocated to one or more provisional second sub-bands from a total number of bits available for the quantization, selects, as one or more fourth sub-bands, one or more sub-bands among the plurality of sub-bands to which no bit is allocated when the provisional first number of bits is allocated to the one or more first sub-bands on the basis of the quantized sub-band energies, calculates a fourth number of bits to be allocated in a case where coding is performed on the one or more fourth sub-bands by the second quantizer, selects the one or more fourth sub-bands and the provisional one or more second sub-bands as the one or more second sub-bands on which the quantization is performed by the second quantizer, and determines a number of bits acquired by subtracting the provisional second number of bits and the fourth number of bits from the total number of bits to be the first number of bits to be allocated to the one or more first sub-bands on which the quantization is performed by the first quantizer, or wherein the tonality calculator is configured to acquire peaky/tonal flags in a high-frequency range, wherein the bit allocator is configured to reserve a provisional second number of bits to be used in the quantization of one or more provisional second sub-bands by the second quantizer, to determine a provisional first number of bits to be allocated to one or more provisional first sub-bands that are to be quantized by the first quantizer on the basis of the quantized sub-band energies to obtain one or more numbers of bits allocated to the one or more provisional first sub-bands, to check the one or more numbers of bits allocated to the one or more provisional first sub-bands in the high-frequency range, to identify the one or more second sub-bands on which the quantization is to be performed by the second quantizer as needed using the provisional one or more second sub-bands and to identify the one or more first sub-bands using the provisional one or more first sub-bands, to update the provisional first number of bits for the first quantizer to obtain the first number of bits, and to recalculate a bit allocation for the first quantizer using the first number of bits.

2. The audio signal coding apparatus according to claim 1, wherein the bit allocator selects the one or more second sub-bands from among the plurality of sub-bands that are in a high-frequency range.

3. The audio signal coding apparatus according to claim 2, wherein the bit allocator selects one or more sub-bands, among the plurality of sub-bands, in which the tonality is lower than a predetermined threshold as the one or more provisional second sub-bands.

4. The audio signal coding apparatus according to claim 2, wherein the bit allocator selects one or more sub-bands among the plurality of sub-bands that has the one or more quantized sub-band energies equal to zero or lower than a predetermined value as the one or more fourth sub-band.

5. The audio signal coding apparatus according to claim 1, wherein the analysis result from the tonality calculator is output as a flag indicating whether or not the tonality is higher than a predetermined threshold.

6. A terminal apparatus comprising:

the audio signal coding apparatus according to claim 1; and an antenna that transmits the coded information.

7. An audio signal decoding apparatus for decoding coded information, the audio signal decoding apparatus comprising: a memory, at least a processor;

a demultiplexer that demultiplexes the coded information into first coded information, second coded information, quantized sub-band energies acquired by quantizing energies of each sub-band among a plurality of sub-bands, and an analysis result for a tonality calculated for each sub-band among the plurality of sub-bands;

a bit allocator that selects the one or more second sub-bands on which decoding is performed by a second decoder from among the plurality of sub-bands on the basis of the analysis result for the tonality and the quantized sub-band energies, and determines a first number of bits to be allocated to one or more first sub-bands, among the plurality of sub-bands, on which decoding is performed by a first decoder; and a frequency-time transformer that generates and outputs an output audio signal by performing a transform on a reconstructed spectrum output from the second decoder into a time domain, wherein the first decoder generates a first decoded spectrum by decoding the first coded information using the first number of bits, and the second decoder generates a second decoded spectrum using decoding the second coded information, and generates the reconstructed spectrum by combining the second decoded spectrum and the first decoded spectrum, wherein the bit allocator determines a provisional first number of bits by subtracting a provisional second number of bits to be allocated to one or more provisional second sub-bands from a total number of bits available for the decoding, selects, as one or more fourth sub-bands, one or more sub-bands among the plurality of sub-bands to which no bit is allocated when the provisional first number of bits is allocated to the one or more first sub-bands on the basis of the quantized sub-band energies, calculates a fourth number of bits to be allocated in a case where coding is performed on the one or more fourth sub-bands by the second decoder, selects the one or more fourth sub-bands and the provisional one or more second sub-bands as the one or more second sub-bands on which the decoding is performed by the second decoder, and determines a number of bits acquired by subtracting the provisional second number of bits and the fourth number of bits from the total number of bits to be the first number of bits to be allocated to the one or more first sub-bands on which the decoding is performed by the first decoder, or wherein the demultiplexer is configured to acquire peaky/tonal flags in a high-frequency range, wherein the bit allocator is configured to reserve a provisional second number of bits to be used in the decoding of one or more provisional second sub-bands by the second decoder, to determine a provisional first number of bits to be allocated to one or more provisional first sub-bands that are to be decoded by the first decoder on the basis of the quantized sub-band energies to obtain one or more numbers of bits allocated to the one or more provisional first sub-bands, to check the one or more numbers of bits allocated to the one or more provisional first sub-bands in the high-frequency range, to identify the one or more second sub-bands on which the decoding is to be performed by the second decoder as needed using the provisional one or more second sub-bands and to identify the one or more first sub-bands using the provisional one or more first sub-bands, to update the provisional first number of bits for the first decoder to obtain the first number of bits, and to recalculate a bit allocation for the first decoder using the first number of bits.

8. The audio signal decoding apparatus according to claim 7, wherein the encoded second information is an encoded lag information, wherein the decoded second information is a decoded lag information, and wherein the second decoder is configured to calculate the reconstructed spectrum using the first decoded spectrum and the lag information.

9. A terminal apparatus comprising:

an antenna that receives and outputs to the demultiplexer the coded information; and the audio signal decoding apparatus according to claim 7.

10. An audio signal coding method comprising:

generating a spectrum by performing a transform on an input audio signal into a frequency domain;

dividing the spectrum into a plurality of sub-bands, which are predetermined frequency bands, and outputting sub-band spectral samples;

acquiring, for each of the plurality of sub-bands, a quantized sub-band energy;

analyzing a tonality of the sub-band spectral samples and outputting an analysis result;

selecting one or more second sub-bands from among the plurality of sub-bands on the basis of the analysis result for the tonality and the quantized sub-band energies;

determining a first number of bits to be allocated to one or more first sub-bands among the plurality of sub-bands;

generating first coded information by coding a sub-band spectral sample among the sub-band spectral samples that is comprised by the one or more first sub-bands by a first coding method using the first number of bits;

generating second coded information by coding a sub-band spectral sample among the sub-band spectral samples that is comprised by the one or more second sub-bands by using a second coding method, wherein the second coding method is configured for calculating lag information for the one or more second sub-bands; and multiplexing together and outputting the first coded information and the second coded information, wherein the determining the first number of bits determines a provisional first number of bits by subtracting a provisional second number of bits to be allocated to one or more provisional second sub-bands from a total number of bits available for the coding, selects, as one or more fourth sub-bands, one or more sub-bands among the plurality of sub-bands to which no bit is allocated when the provisional first number of bits is allocated to the one or more first sub-bands on the basis of the quantized sub-band energies, calculates a fourth number of bits to be allocated in a case where coding is performed on the one or more fourth sub-bands using the second coding method, selects the one or more fourth sub-bands and the provisional one or more second sub-bands as the one or more second sub-bands on which the coding is performed using the second coding method, and determines a number of bits acquired by subtracting the provisional second number of bits and the fourth number of bits from the total number of bits to be the first number of bits to be allocated to the one or more first sub-bands on which the coding is performed using the first coding method, or wherein the analyzing acquires peaky/tonal flags in a high-frequency range, wherein the determining the first number of bits is configured to reserve a provisional second number of bits to be used in using the second coding method, to determine a provisional first number of bits to be allocated to one or more provisional first sub-bands that are to be coded using the first coding method on the basis of the quantized sub-band energies to obtain one or more numbers of bits allocated to the one or more provisional first sub-bands, to check the one or more numbers of bits allocated to the one or more provisional first sub-bands in the high-frequency range, to identify the one or more second sub-bands on which the coding is to be performed using the second coding method as needed using the provisional one or more second sub-bands and to identify the one or more first sub-bands using the provisional one or more first sub-bands, to update the provisional first number of bits for the first coding method to obtain the first number of bits, and to recalculate a bit allocation for the first coding method using the first number of bits.

11. An audio signal decoding method for decoding coded information, the audio signal decoding method comprising:

demultiplexing the coded information into first coded information, second coded information, quantized subband energies for each sub-band among a plurality of sub-bands, and an analysis result for a tonality calculated for each sub-band among the plurality of sub-bands;

selecting one or more second sub-bands from among the plurality of sub-bands on the basis of the analysis result for the tonality and the quantized sub-band energies;

determining a first number of bits to be allocated to one or more first sub-bands among the plurality of sub-bands;

generating a first decoded spectrum by decoding the first coded information using the first number of bits;

generating a second decoded spectrum using decoding the second coded information, and generating a reconstructed spectrum by combining the second decoded spectrum and the first decoded spectrum; and generating and outputting an output audio signal by performing a transform on the reconstructed spectrum into a time domain, wherein the determining the first number of bits determines a provisional first number of bits by subtracting a provisional second number of bits to be allocated to one or more provisional second sub-bands from a total number of bits available for the decoding, selects, as one or more fourth sub-bands, one or more sub-bands among the plurality of sub-bands to which no bit is allocated when the provisional first number of bits is allocated to the one or more first sub-bands on the basis of the quantized sub-band energies, calculates a fourth number of bits to be allocated in a case where decoding is performed on the one or more fourth sub-bands in the decoding the second information, selects the one or more fourth sub-bands and the provisional one or more second sub-bands as the one or more second sub-bands on which the decoding the second coded information is performed, and determines a number of bits acquired by subtracting the provisional second number of bits and the fourth number of bits from the total number of bits to be the first number of bits to be allocated to the one or more first sub-bands on which the decoding the first coded information is performed, or wherein the demultiplexing acquires peaky/tonal flags in a high-frequency range, wherein the determining the first number of bits is configured to reserve a provisional second number of bits to be used in the decoding the second coded information, to determine a provisional first number of bits to be allocated to one or more provisional first sub-bands that are to be decoded in the decoding the first coded information on the basis of the quantized sub-band energies to obtain one or more numbers of bits allocated to the one or more provisional first sub-bands, to check the one or more numbers of bits allocated to the one or more provisional first sub-bands in the high-frequency range, to identify the one or more second sub-bands on which the decoding is to be performed in the decoding the second coded information as needed using the provisional one or more second sub-bands and to identify the one or more first sub-bands using the provisional one or more first sub-bands, to update the provisional first number of bits for the decoding the first coded information to obtain the first number of bits, and to recalculate a bit allocation for the decoding the first coded information using the first number of bits.

12. A non-transitory digital storage medium having a computer program stored thereon to perform the audio signal coding method comprising:

generating a spectrum by performing a transform on an input audio signal into a frequency domain;

dividing the spectrum into a plurality of sub-bands, which are predetermined frequency bands, and outputting sub-band spectral samples;

acquiring, for each of the plurality of sub-bands, a quantized sub-band energy;

analyzing a tonality of the sub-band spectral samples and outputting an analysis result;

selecting one or more second sub-bands from among the plurality of sub-bands on the basis of the analysis result for the tonality and the quantized sub-band energies;

determining a first number of bits to be allocated to one or more first sub-bands among the plurality of sub-bands;

generating first coded information by coding a sub-band spectral sample among the sub-band spectral samples that is comprised by the one or more first sub-bands by a first coding method using the first number of bits;

generating second coded information by coding a sub-band spectral sample among the sub-band spectral samples that is comprised by the one or more second sub-bands by using a second coding method, wherein the second coding method is configured for calculating lag information for the one or more second sub-bands; and multiplexing together and outputting the first coded information and the second coded information, wherein the determining the first number of bits determines a provisional first number of bits by subtracting a provisional second number of bits to be allocated to one or more provisional second sub-bands from a total number of bits available for the coding, selects, as one or more fourth sub-bands, one or more sub-bands among the plurality of sub-bands to which no bit is allocated when the provisional first number of bits is allocated to the one or more first sub-bands on the basis of the quantized sub-band energies, calculates a fourth number of bits to be allocated in a case where coding is performed on the one or more fourth sub-bands using the second coding method, selects the one or more fourth sub-bands and the provisional one or more second sub-bands as the one or more second sub-bands on which the coding is performed using the second coding method, and determines a number of bits acquired by subtracting the provisional second number of bits and the fourth number of bits from the total number of bits to be the first number of bits to be allocated to the one or more first sub-bands on which the coding is performed using the first coding method, or wherein the analyzing acquires peaky/tonal flags in a high-frequency range, wherein the determining the first number of bits is configured to reserve a provisional second number of bits to be used in using the second coding method, to determine a provisional first number of bits to be allocated to one or more provisional first sub-bands that are to be coded using the first coding method on the basis of the quantized sub-band energies to obtain one or more numbers of bits allocated to the one or more provisional first sub-bands, to check the one or more numbers of bits allocated to the one or more provisional first sub-bands in the high-frequency range, to identify the one or more second sub-bands on which the coding is to be performed using the second coding method as needed using the provisional one or more second sub-bands and to identify the one or more first sub-bands using the provisional one or more first sub-bands, to update the provisional first number of bits for the first coding method to obtain the first number of bits, and to recalculate a bit allocation for the first coding method using the first number of bits;

when said computer program is run by a computer.

13. A non-transitory digital storage medium having a computer program stored thereon to perform the audio signal decoding method for decoding coded information, the audio signal decoding method comprising:

demultiplexing the coded information into first coded information, second coded information, quantized sub-band energies for each sub-band among a plurality of sub-bands, and an analysis result for a tonality calculated for each sub-band among the plurality of sub-bands;

selecting one or more second sub-bands from among the plurality of sub-bands on the basis of the analysis result for the tonality and the quantized sub-band energies;

determining a first number of bits to be allocated to one or more first sub-bands among the plurality of sub-bands;

generating a first decoded spectrum by decoding the first coded information using the first number of bits;

generating a second decoded spectrum using decoding the second coded information, and generating a reconstructed spectrum by combining the second decoded spectrum and the first decoded spectrum; and generating and outputting an output audio signal by performing a transform on the reconstructed spectrum into a time domain, wherein the determining the first number of bits determines a provisional first number of bits by subtracting a provisional second number of bits to be allocated to one or more provisional second sub-bands from a total number of bits available for the decoding, selects, as one or more fourth sub-bands, one or more sub-bands among the plurality of sub-bands to which no bit is allocated when the provisional first number of bits is allocated to the one or more first sub-bands on the basis of the quantized sub-band energies, calculates a fourth number of bits to be allocated in a case where decoding is performed on the one or more fourth sub-bands in the decoding the second information, selects the one or more fourth sub-bands and the provisional one or more second sub-bands as the one or more second sub-bands on which the decoding the second coded information is performed, and determines a number of bits acquired by subtracting the provisional second number of bits and the fourth number of bits from the total number of bits to be the first number of bits to be allocated to the one or more first sub-bands on which the decoding the first coded information is performed, or wherein the demultiplexing acquires peaky/tonal flags in a high-frequency range, wherein the determining the first number of bits is configured to reserve a provisional second number of bits to be used in the decoding the second coded information, to determine a provisional first number of bits to be allocated to one or more provisional first sub-bands that are to be decoded in the decoding the first coded information on the basis of the quantized sub-band energies to obtain one or more numbers of bits allocated to the one or more provisional first sub-bands, to check the one or more numbers of bits allocated to the one or more provisional first sub-bands in the high-frequency range, to identify the one or more second sub-bands on which the decoding is to be performed in the decoding the second coded information as needed using the provisional one or more second sub-bands and to identify the one or more first sub-bands using the provisional one or more first sub-bands, to update the provisional first number of bits for the decoding the first coded information to obtain the first number of bits, and to recalculate a bit allocation for the decoding the first coded information using the first number of bits;

when said computer program is run by a computer.

* * * * *